US010087053B2

(12) United States Patent
Topping, Jr. et al.

(10) Patent No.: US 10,087,053 B2
(45) **Date of Patent: *Oct. 2, 2018**

(54) MANUAL MARINE WINCH WITH SAFETY KNOCKOUT OVERRIDE PREVENTING RELEASE OF WINCH TENSION WITHOUT THE HANDLE IN THE STOWED POSITION

(71) Applicant: W. W. Patterson Company, Pittsburgh, PA (US)

(72) Inventors: Richard A Topping, Jr., Pittsburgh, PA (US); Donald Joseph Sluka, North Huntington, PA (US)

(73) Assignee: W.W. PATTERSON COMPANY, Pittsburgh, PA (US)

( * ) Notice: Subject to any disclaimer, the term of this patent is extended or adjusted under 35 U.S.C. 154(b) by 621 days.

This patent is subject to a terminal disclaimer.

(21) Appl. No.: 14/686,731

(22) Filed: Apr. 14, 2015

(65) Prior Publication Data

US 2015/0217977 A1 Aug. 6, 2015

Related U.S. Application Data

(63) Continuation of application No. 13/894,057, filed on May 14, 2013, now Pat. No. 9,004,456.

(60) Provisional application No. 61/646,658, filed on May 14, 2012.

(51) Int. Cl.

| | |
|---|---|
| ***B66D 1/06*** | (2006.01) |
| ***B66D 1/54*** | (2006.01) |
| ***B66D 3/14*** | (2006.01) |

(52) U.S. Cl.

CPC ..... *B66D 1/06* (2013.01); *B66D 1/54* (2013.01); *B66D 3/14* (2013.01)

(58) Field of Classification Search

CPC ... B66D 1/06; B66D 1/50; B66D 1/54; B66D 3/02; B66D 5/16; B66D 2700/0116

See application file for complete search history.

(56) References Cited

U.S. PATENT DOCUMENTS

| | | | |
|---|---|---|---|
| 2,278,681 | A | 4/1942 | Thul |
| 3,939,729 | A | 2/1976 | Brockelsby |
| 4,008,881 | A | 2/1977 | Ross |

(Continued)

FOREIGN PATENT DOCUMENTS

| | | |
|---|---|---|
| JP | 2005067758 | 3/2005 |

*Primary Examiner* — Emmanuel Monsayac Marcelo
(74) *Attorney, Agent, or Firm* — Blynn L. Shideler; Krisanne Shideler; BLK Law Group

(57) ABSTRACT

A manual marine winch includes a safety knockout override preventing release of winch tension without the handle in stowed position. The winch includes a housing; a rotating drum on the housing; a winch line on the drum; a control for spooling and un-spooling the winch line on the drum, wherein the control includes a handle for selectively tensioning the drum and moveable between a position engaged with the drum and a disengaged stowed position; a tension holding mechanism on the housing comprising a ratchet gear coupled to the drum, a pawl selectively engaged with the ratchet gear, and a knockout configures to selectively disengage the pawl from the gear to allow for release of winch tension; and a safety knockout override coupled to the housing and selectively engaged by the handle and configured to prevent release of winch tension when the handle is not in the stowed position.

20 Claims, 4 Drawing Sheets

(56) References Cited

U.S. PATENT DOCUMENTS

| | | | | |
|---|---|---|---|---|
| 4,106,754 | A | 8/1978 | Kucher | |
| 4,155,537 | A | 5/1979 | Bronson et al. | |
| 4,268,012 | A | 5/1981 | Ruehle et al. | |
| 4,456,227 | A | 6/1984 | Notenboom | |
| 4,566,674 | A | 1/1986 | Ebey | |
| 5,287,950 | A | 2/1994 | Feathers et al. | |
| 5,947,450 | A | 9/1999 | Grapes | |
| 6,116,580 | A | 9/2000 | Hull | |
| 6,431,525 | B1 | 8/2002 | Roll | |
| 6,572,083 | B1 | 6/2003 | Topping, Jr. | |
| 6,644,630 | B1 | 11/2003 | Lorenz | |
| 6,726,182 | B2 | 4/2004 | Topping, Jr. | |
| 6,799,751 | B1 | 10/2004 | Anderson | |
| 6,938,881 | B2 | 9/2005 | Grapes | |
| 7,128,307 | B2 | 10/2006 | Dow | |
| 7,159,852 | B2 | 1/2007 | Dow | |
| 7,413,170 | B2 | 8/2008 | Ruan | |
| 7,484,713 | B1 | 2/2009 | Young | |
| 7,543,800 | B2 | 6/2009 | Grapes et al. | |
| 7,686,282 | B2 | 3/2010 | Amoss et al. | |
| 2002/0130309 | A1 | 9/2002 | Hulburd | |
| 2003/0057409 | A1 | 3/2003 | Grapes | |
| 2007/0114504 | A1 | 5/2007 | Ruan | |
| 2008/0303007 | A1 | 12/2008 | Drinkhorn | |
| 2012/0068132 | A1* | 3/2012 | Grapes ..... | B66D 1/04<br>254/352 |
| 2013/0306924 | A1 | 11/2013 | Topping et al. | |

* cited by examiner

MANUAL MARINE WINCH WITH SAFETY KNOCKOUT OVERRIDE PREVENTING RELEASE OF WINCH TENSION WITHOUT THE HANDLE IN THE STOWED POSITION

RELATED APPLICATIONS

This application is a continuation of U.S. patent application Ser. No. 13/894,057 filed May 14, 2013 entitled "Manual Marine Winch with Safety Knockout Override Preventing Release of Winch Tension without the Handle in the Stowed Position" which published Nov. 21, 2013 as U.S. Publication Number 2013-0306924 and which issued Apr. 14, 2015 as U.S. Pat. No. 9,004,456, and this publication and issued patent are incorporated herein by reference in their entireties.

U.S. patent application Ser. No. 13/894,057 claims the benefit of U.S. Provisional patent application Ser. No. 61/646,658 filed May 14, 2012 entitled "Manual Marine Winch with Safety Knockout Override Preventing Release of Winch Tension without the Handle in the Stowed Position" which is incorporated herein by reference in its entirety.

BACKGROUND OF THE INVENTION

1. Field of the Invention

The present invention relates to manual winches with knockout tension release mechanisms, more particularly, the present invention relates to manual marine winches with safety knockout override preventing release of winch tension without the handle in the stowed position.

2. Background Information

General Manual Marine Winches

Winches have been used in many applications. The present invention relates to manual winches which have been widely used in barges, tow boats and the like. Typically such a manual winch is attached to a boat deck and spools a towing cable or winch line on a rotating drum.

Manual winches remain in common use where a powered winch would be impractical or inefficient. In a manual winch the operator, through various mechanical advantages, can generate a very large tension on the winch line. Examples of manual winches are described in greater detail in U.S. Pat. No. 5,947,450 which is incorporated herein by reference. Examples of manual winches are sold by W. W. Patterson Company, Nabrico and Nashville Bridge Company. Other representative examples are found in U.S. Pat. Nos. 4,106,754; 4,456,227; 4,566,674; 6,431,525; 6,572,083; 6,726,182; 6,938,881; 7,128,307; 7,179,852; 7,686,282, which are incorporated herein by reference.

A background summary of conventional winch design may be helpful to fully understand the scope and operation of the present invention.

The conventional prior art manual marine winch 10, similar to manual winches which are described in U.S. Pat. No. 5,947,450, is shown in FIG. 1 and includes a base plate 12 and a pair of spaced side plates 14 surrounding a rotatable spool or drum assembly. The rotatable spool assembly is rotationally supported between the side plates 14 and includes a drum 16, a protecting flange on one side of the drum 16 and a controlling gear 20 on the other side of the drum 16. A control assembly is supported by the side plates 14 and engages with the gear 20 to rotate the drum 16 for spooling of a cable (not shown) or wire rope or winch line thereon. The control assembly extends through one side plate 14. The control assembly includes a hand wheel 24 and an actuating lever or handle 26, also called a ratchet handle 26, each of which are used for manually operating the winch 10.

The ratchet handle 26 will typically have a stowed position, generally the rearward position, in which it is disengaged from the gearing associated with the drum 16. The stowed position may have a stop secured to the sidewall or side plate 14 acting as a rest for the handle 26 and a visual indicator that the handle is in the stowed position. As the handle 26 is rotated away from the stowed position it will engage the gearing associated with the drum to allow for tensioning of the drum and associated winch line, in a conventional fashion known in the art.

A foot brake 28 may be attached to the side plate 14 through which the control assembly extends. The foot brake 28 is adapted to frictionally engage the hand wheel 24. A swivel link 30 may be attached to the base plate 12 at a rear of the winch 10 and pivotally attaches the winch 10 to a D-ring 32 of a boat deck or the like. A step or foot 34 is attached to the underside of the base plate 12 near a forward portion of the winch 10. A gear guard 36 is attached to one of the side plates 14 on the same side as the gear 20 and is positioned in a cutout formed in the side plate 14. The gear guard 36 prevents the cable from interfering with or becoming wrapped behind the gear 20. Similarly, a flange guard is attached to the other side plate 14 in a cutout formed therein. The flange guard prevents the cable from being wrapped behind the flange.

The construction of the manual swivel winch 10 may include the use of four tubular spacers (not shown) for spacing the side plates 14 apart. A bolt 40 extends through the center of each spacer through aligned holes in the opposed side plates 14 and is secured by nuts 42.

In a conventional marine winch a wire rope, the winch line, is spooled back and forth around the rotating drum and the winch line is subject to very large loads. The high loading can cause the outer layers of wire rope to become fouled, jammed or begin binding within the spaces between the lower level wire ropes. Further, rapid tension release in existing wire rope winch systems can result in what is known as "bird-nesting" of the spooled wire rope. This can make unwinding the winch very difficult in subsequent operation, and often requires a second deck hand to assist in the unwinding of the wire rope, or even the engine power of the tow boat. U.S. Pat. No. 7,543,800 which is incorporated herein by reference addressed some of these problems with the design and implementation of a "single stack" winch.

A single stack winch 50 as described in U.S. Pat. No. 7,543,800, which is incorporated herein by reference, is disclosed in FIG. 2 which illustrates a winch 50 that includes a pair of spaced side plates 54 defining an open bottom. A rotating spool or drum assembly is supported between the side plates 54 and includes drum 56 with a protecting flange 58 on one side of the drum 56 and a controlling drum gear 60 on the other side of the drum 56. The construction of the spool or drum assembly is a key feature of the single stack winch 50 design. Adjacent the drum gear 60 is a stacking flange which is spaced from the drum gear 60 a distance sufficient to receive a single width of winch line. The winch 50 includes stacking area fender 70 as a protective fender and a protective plate 72 with rope access slot 74 further protecting the stacking space and a spacer or support 90.

The U.S. Pat. No. 7,543,800 further notes that the remaining elements of the winch 50 are conventional and known to those in the art. For example the winch includes a hand wheel 76 and lever tension mechanism, also known as a ratchet handle 78 is used to rotate the drum gear 60 through gearing 80 in a conventional fashion. The ratchet handle 78 will typically have a stowed position, generally the rearward position, in which it is disengaged from the gearing associated with the drum 16, but as the ratchet handle 78 is rotated it will engage the gearing associated with the drum to allow for tensioning of the drum and associated winch line.

The tension is held on ratchet gears 82 that are engaged with pawls 84. In conventional tensioning operation for the winch 50 the pawls 84 are engaged with the ratchet gears 82 and the operator will rapidly wind up the winch line, and increase the tension, initially through the operation of the hand wheel 76. Once the tension reaches a relatively high amount on the winch line, the operator will continue the tensioning through the repeated use of the ratchet handle 78, often with the use of a handle extension or a "cheater bar" to add increased leverage. Once the final tension is achieved it is intended for the operator to move the handle to the disengaged or stowed position, typically the rearward position, to prepare the winch for tension release when desired.

A knockout lever 86, also known in the art, is used to disengage the pawls 84 from the gears 82 to release tension on the winch 50, when desired. When controlled payout is desired the footbrake is engaged and the knockout lever 86 is utilized to disengage the pawls 84 from the gears 82 to allow for slow payout. Often the tension release is allowed to be somewhat rapid. The knockout lever 86 is so named as it is often struck to be knocked out of engagement.

Unintentional Handle Rotation with Knockout Operation

The manual tensioning handles of known marine winches, such as handles 26 and 78 of the winches 10 and 50 of FIGS. 1 and 2, respectively, should be disengaged to allow for safe unloading or payout of the winch line. If the tension is released on the drum through a knockout device, such as lever 86, with the handles 26 or 78 still accidentally engaged, the handles naturally will rotate, through the gearing, with the drum. In such a case, with the drum under high loads or tension, the accidentally drum-engaged handles can be rotated quite fast and violently before striking a rear stop or the ship's deck. Aside to damaging the handles in this movement, of far greater concern is the potential injury to workers around the winch during such accidental winch handle movement.

The danger of unintended handle movement is only heightened if a handle extension, also called a cheater bar, is left on the handle that is left engaged with the gearing. A cheater bar is merely a length of pipe that operators have been known to add to the manual marine winch handle to increase the effective lever arm available to the operator for ease of tensioning the winch 10 or 50. Operators have broken arms and legs due to such undesired violent handle and cheater bar motion during knockout operation.

U.S. Patent Application Publication No. 2012-0068132, which is incorporated herein by reference, provides one solution to this handle problem with the design of a manual marine winch that includes a self releasing handle. The handle includes i) a ratchet gear coupled to the drum wherein rotation of the ratchet gear will cause rotation of the drum, ii) a rotating handle body with a manual end grip, iii) a user engaged trigger mechanism on the end grip moveable between an engaged position and a release position, and iv) a handle locking pawl on the handle body and coupled to the trigger mechanism and moveable between a position engaged with the ratchet gear rotationally securing the handle body to the ratchet gear and the drum when the trigger is in the engaged position and a position disengaged with the ratchet gear rotationally separating the handle body from the ratchet gear and the drum when the trigger is not in the engaged position.

The self releasing handle represents a relatively complex handle and may not be adopted by all winch users. Thus there remains a need for preventing undesired handle movement during tension release on manual marine winches with the operation of a knockout device.

It is an object of the present invention to minimize the drawbacks of the existing manual winch handles and to provide a simple easy and safe marine winch.

SUMMARY OF THE INVENTION

The various embodiments and examples of the present invention as presented herein are understood to be illustrative of the present invention and not restrictive thereof and are non-limiting with respect to the scope of the invention.

At least some of the above stated objects are achieved with a manual marine winch with safety knockout override preventing release of winch tension without the handle in stowed position.

A manual marine winch according to the invention includes a winch housing; a rotating drum assembly supported on the winch housing; a winch line selectively spooled and un-spooled on the drum; a manually actuated control for spooling and un-spooling the winch line on the drum, wherein the manually actuated control includes a handle for selectively tensioning the drum and moveable between a position engaged with the drum in at least one rotational direction for tensioning of the winch line on the drum and stowed position wherein the handle is not engaged with the drum; a tension holding mechanism on the winch housing comprising at least one ratchet gear coupled to the drum, at least one pawl selectively engaged with at least one ratchet gear to hold tension on the winch line on the drum, and a knockout configures to selectively disengage each of the pawls from the gears to allow for release of tension on the winch; and a safety knockout override coupled to the winch housing and selectively engaged by the handle and configured to prevent release of winch tension when the handle is not in the stowed position.

The marine winch of according to one aspect of the invention may proved that the safety knockout override includes a pair of one leg members extending from and pivoting about a pivot member coupled to the winch housing. Further, the safety knockout override may further include a spring member coupled to one leg member and biasing the safety knockout override to a position preventing release of winch tension. The winch may be configured such that movement of the handle to the stowed position will pivot the leg members to a position allowing release of winch tension.

The present invention may provide that one leg member includes a projecting stop at a distal end thereof spaced from the pivot member. The marine winch of the invention may be provided such that the stop is selectively engaged with one of the knockout or each of the pawls of the tension holding mechanism when the handle is not in the stowed position and configures to prevent disengagement of the pawls from the associated ratchet gear when the handle is not in the stowed position.

In some embodiments of the present invention the marine winch is constructed such that the pivot member extends substantially parallel to an axis of the drum, while alternative arrangements provide that the pivot member extends substantially perpendicular to an axis of the drum. In one embodiment of the invention, the safety knockout override includes a gear coupled to the drum and selectively engaged by the projecting stop when the handle is not in the stowed position.

These and other advantages of the present invention will be clarified in the brief description of the preferred embodiment taken together with the drawings in which like reference numerals represent like elements throughout.

DESCRIPTION OF THE PREFERRED EMBODIMENTS

Figure 1:
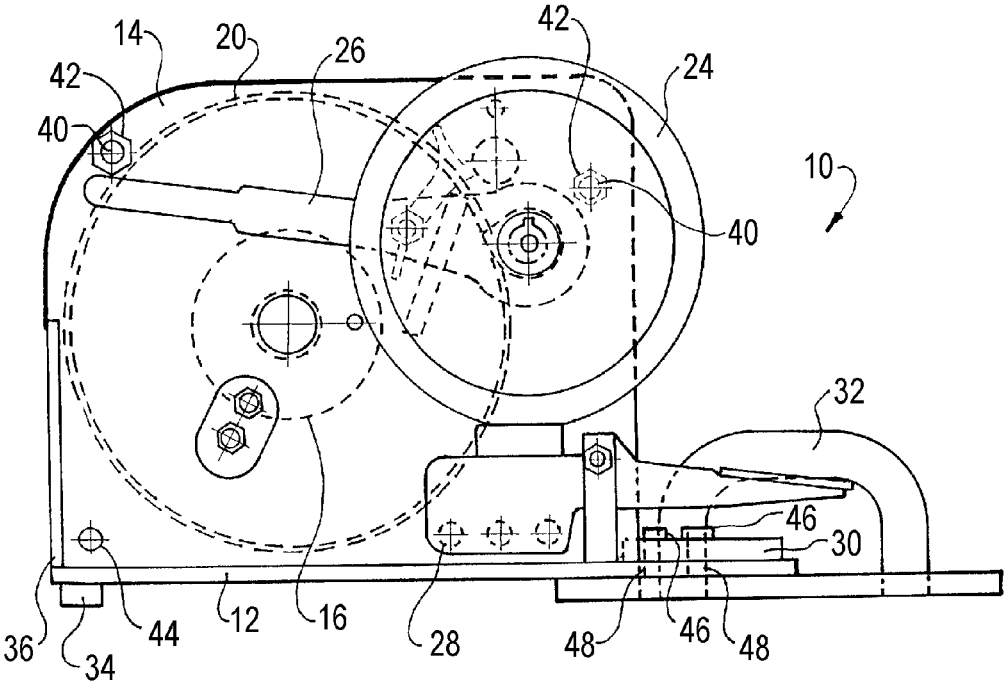
FIG. 1 PRIOR ART
FIG. 1 is a schematic side elevation of a conventional prior art manual marine winch which can implement a safety knockout override preventing release of winch tension without the handle in stowed position according to the present invention.
Figure 2:
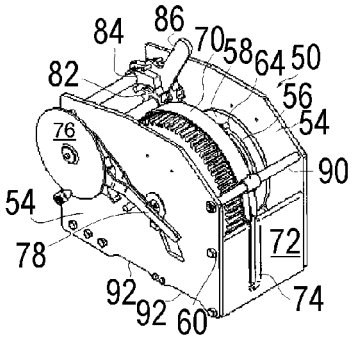
FIG. 2 PRIOR ART
FIG. 2 is a schematic perspective view of a single stack manual marine winch which can implement a safety knockout override preventing release of winch tension without the handle in stowed position according to the present invention.

FIG. 1 is a schematic side elevation of a conventional prior art manual marine winch 10 discussed above which can implement a safety knockout override 100 preventing release of winch tension without the handle 26 in stowed position according to the present invention. Further, FIG. 2 is a schematic perspective view of a single stack manual marine winch 50, also discussed above, which can implement a safety knockout override 100 preventing release of winch tension without the handle in stowed position according to the present invention. The release of winch tension can be also referenced as "paying out", "unspooling", "unwinding" of the winch line, and is used herein to reference the act of actuating the knock-out, such as lever 86, to disengage the pawls (also called locking dogs) from the gearing such as 82. The drum tension in this release of winch tension may actually be maintained by a foot brake or hand brake or via a secure gripping of the hand wheel by the operator.

The safety knockout override of the present invention can be incorporated into any winch 10 or 50 having a winch housing (formed by side plates 14 or 54 and associated structure in winches 10 and 50 respectively); a rotating drum assembly (formed by drum 16 or 56 and associated structure in winches 10 and 50, respectively) supported on the winch housing; and a winch line selectively spooled and unspooled on the drum, a manually actuated control for spooling and un-spooling the winch line on the drum, wherein the manually actuated control includes a handle (formed by handles 26 and 78 and associated structure in winches 10 and 50, respectively) for selectively tensioning the drum and moveable between a position engaged with the drum in at least one rotational direction for tensioning of the winch line on the drum and stowed position wherein the handle is not engaged with the drum; and a tension holding mechanism on the winch housing comprising at least one ratchet gear (82 in winch 50, not clearly illustrated in winch 10) coupled to the drum, at least one pawl (84 in winch 50, not clearly illustrated in winch 10) selectively engaged with at least one ratchet gear to hold tension on the winch line on the drum, and a knockout (86 in winch 50, not clearly illustrated in winch 10) configures to selectively disengage each of the pawls from the gears to allow for release of tension on the winch. The remaining portions of the brief description of the preferred embodiments will reference winch numerals from winch 50, but it would be apparent winch 10 and other similar prior art winches can implement the safety knockout override 100 preventing release of winch tension without the handle in stowed position according to the present invention.

In each embodiment of the present invention the safety knockout override 100 is coupled to the winch housing, namely side plate 54, and selectively engaged by the handle 78 and configured to prevent release of winch tension when the handle is not in the stowed position.

Figure 4:
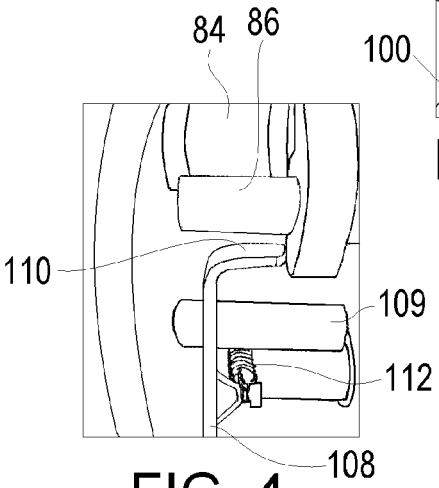
Figure 5:
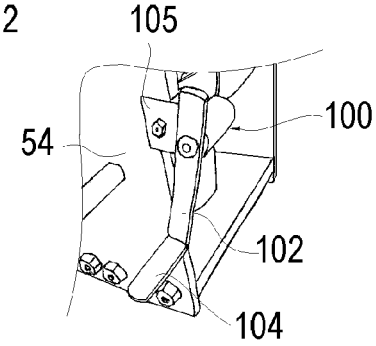
Figure 7:
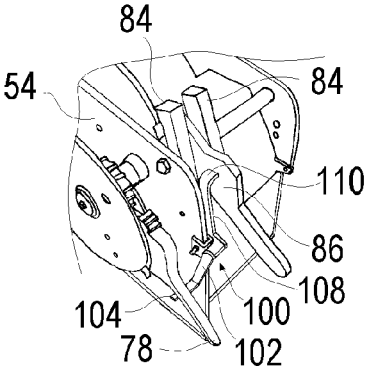
FIG. 7 is an illustration of the safety knockout override according to the first embodiment of the present invention shown in FIGS. 3-5, wherein the safety knockout override is positioned to allow the release of winch tension and the knockout has been operated to release the pawls and allow for release of winch tension.
Figure 6:
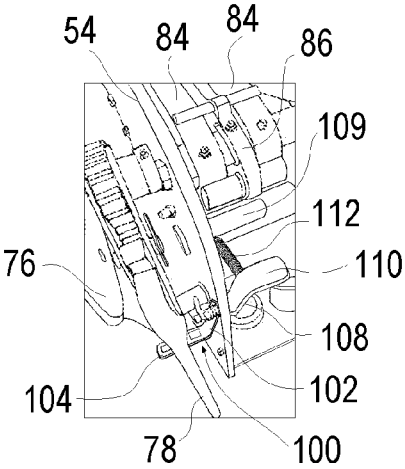
FIG. 6 is an illustration of the safety knockout override according to the a modification of the first embodiment of the present invention shown in FIGS. 3-5, wherein the safety knockout override is positioned to allow the release of winch tension.
Figure 8:
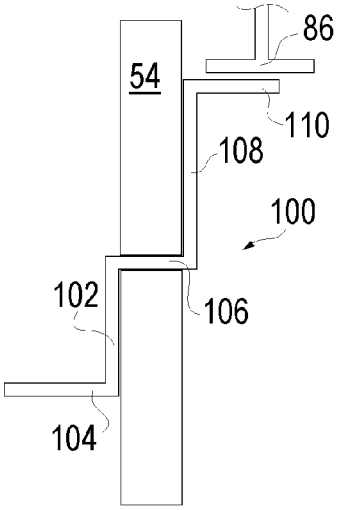
FIG. 8 is a schematic end view of the safety knockout override according to the first embodiment of the present invention shown in FIGS. 3-5.
Figure 9:
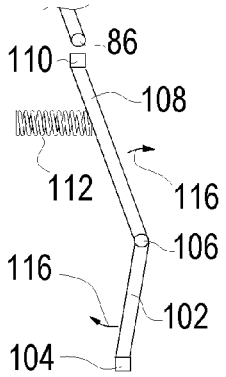
FIG. 9 is a schematic side view of the safety knockout override according to the first embodiment of the present invention in the position shown in FIGS. 3-5.
Figure 10:
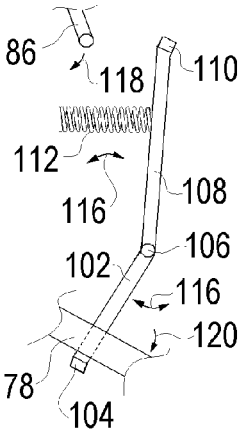
FIG. 10 is a schematic side view of the safety knockout override according to the first embodiment of the present invention in the position shown in FIG. 6.

Further in each embodiment illustrated herein the safety knockout override 100 includes a pair of one leg members 102 and 108 extending from and pivoting about a pivot member 106 coupled to the winch housing side plate 54. The coupling may be through a separate add-on coupling member 105 as shown in FIGS. 3-5 and 7 or the coupling may be through a hole in the side plate 54 for mounting the pivot member 106 (possibly including bearings as needed) such as shown in FIG. 6 and schematically in FIG. 8. The use of the add-on coupling member 105 allows for easy retrofitting of existing winches.

The first leg member 102 is configured to engage the handle 78 and may include a handle engaging stop 104 at a distal end thereof to engage the handle, such as in the first embodiments shown in FIGS. 3-10.

Figure 12:
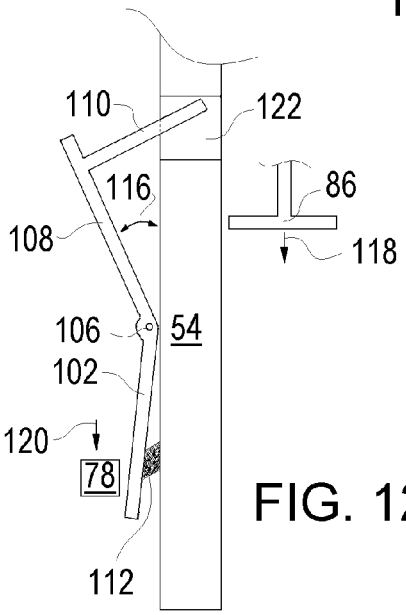
FIG. 12 is a schematic end view of the safety knockout override according to the second embodiment of the present invention, wherein the safety knockout override is positioned to allow the release of winch tension.
Figure 13:
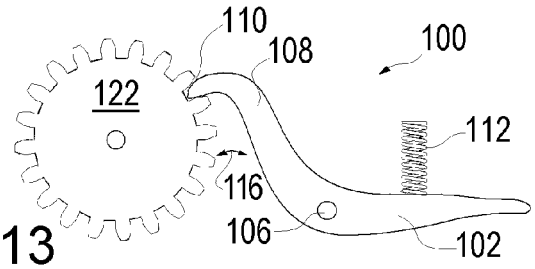
FIG. 13 is a schematic side view of the safety knockout override according to a third embodiment of the present invention, wherein the safety knockout override is positioned to prevent the release of winch tension.
Figure 14A:
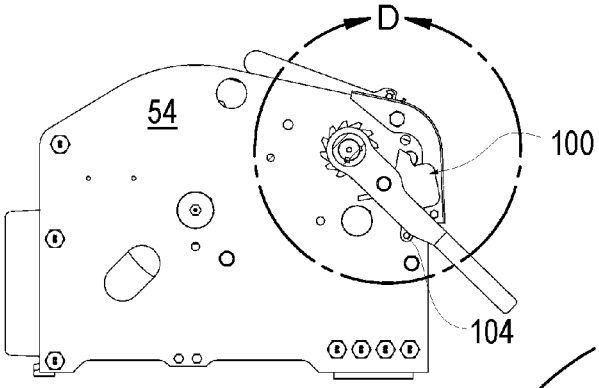
FIGS. 14A and B are a schematic side view and enlarged view thereof, respectively, with the hand wheel removed for clarity, of the safety knockout override according to a version of the first embodiment of the present invention, wherein the safety knockout override is positioned to allow the release of winch tension.
Figure 14B:
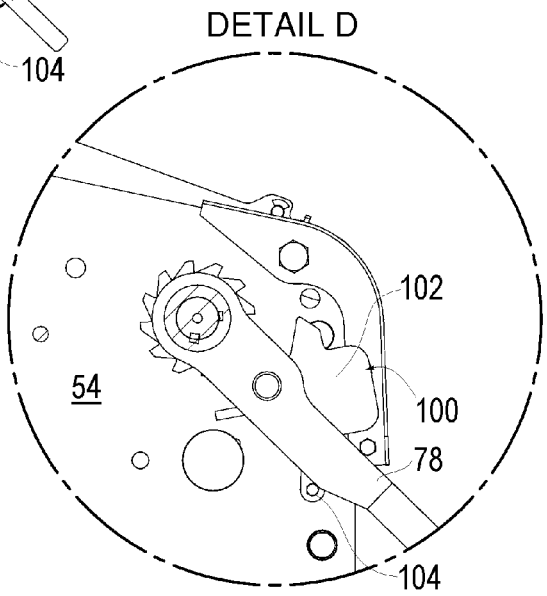
Figure 15A:
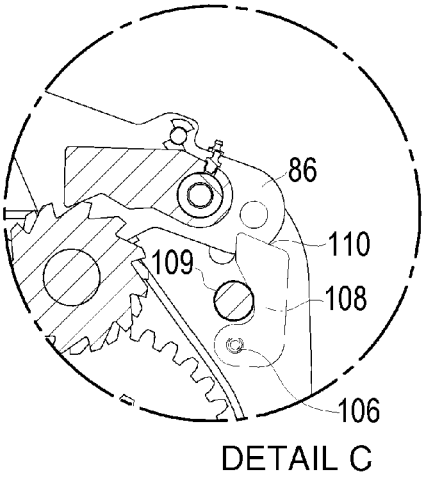
FIGS. 15A and B are a schematic side sectional view and enlarged view thereof, respectively, of the safety knockout override according to FIGS. 14A and B, wherein the safety knockout override is positioned to allow the release of winch tension.
Figure 15B:
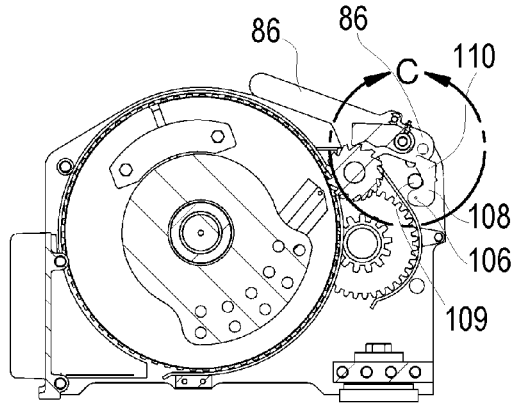

The pivot member 106 may extend substantially parallel to an axis of the drum as in the first embodiment shown in FIGS. 3-10 and FIGS. 14-15 or the third embodiment shown in FIG. 13. Alternatively, the pivot member 106 may extend substantially perpendicular to an axis of the drum, as shown in the second embodiment of FIGS. 11-12.

Figure 3:
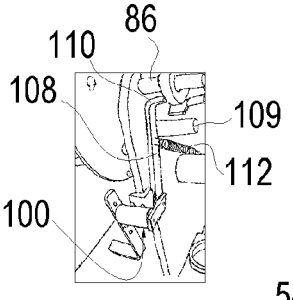
FIGS. 3-5 are illustrations of a safety knockout override according to a first embodiment of the present invention configured for preventing release of winch tension without the handle in stowed position, wherein the safety knockout override is positioned to prevent the release of winch tension.

The safety knockout override 100 further includes a spring member 112 coupled to one leg member 102 and biasing the safety knockout override 100 to a position preventing release of winch tension. FIGS. 3-5 are illustrations of a safety knockout override 100 according to a first embodiment of the present invention, wherein the safety knockout override 100 is positioned as shown to prevent the release of winch tension.

Figure 11:
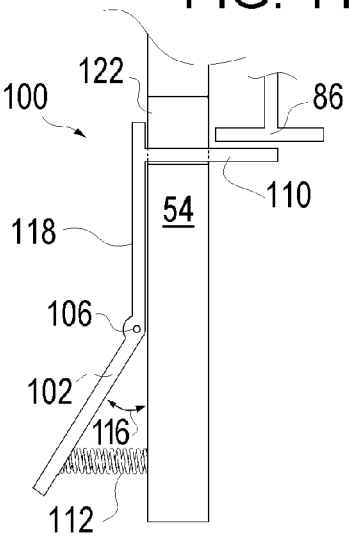
FIG. 11 is a schematic end view of the safety knockout override according to a second embodiment of the present invention, wherein the safety knockout override is positioned to prevent the release of winch tension.

Similarly FIG. 11 is a schematic end view of the safety knockout override 100 according to a second embodiment of the present invention, wherein the safety knockout override 100 is positioned as shown to prevent the release of winch tension.

Finally, FIG. 13 is a schematic side view of the safety knockout override 100 according to a third embodiment of the present invention, wherein the safety knockout override 100 is positioned as shown to prevent the release of winch tension.

The spring member 112 as shown is coupled to one leg member 108 for biasing the safety knockout override 100 to a position preventing release of winch tension, however it could be easily designed to operate on the other leg 102 for such purpose. Further a torsion spring on pivot member 106 could have a similar effect. The spring member 112 will pull the leg 108 against a stop 109 coupled to the housing 54. The stop 109 may be a separate member, or it may be an existing component of the winch, such as a spreader or cross support. The leg 108 is designed such that when it is pulled against the stop 109 the leg will position the projecting stop 110 properly to prevent movement of the knockout 86 as discussed below.

As noted, the one leg member 108 includes a projecting stop 110 at a distal end thereof spaced from the pivot member 106. In the first two embodiments of the invention the stop 110 is selectively engaged with the knockout lever 86, and/or each of the pawls 84, if desired, of the tension holding mechanism when the handle 78 is not in the stowed position. As discussed below, this position of the stop 110 in the first two embodiments prevents disengagement of the pawls 84 from the associated ratchet gear 82 when the handle 78 is not in the stowed position. As discussed below, this position of the stop 110 in the third embodiment of the invention prevents winch tension release when the handle 78 is not in the stowed position through engagement with a separate tension holding gear 122.

As noted above, the winch tension is held on ratchet gears 82 that are engaged by pawls 84. Reiterating, in conventional tensioning operation for the winch 50 the pawls 84 are engaged with the ratchet gears 82 and the operator will rapidly wind up the winch line, and increase the tension, initially through the operation of the hand wheel 76. Once the tension reaches a relatively high amount on the winch line, the operator will continue the tensioning through the repeated use of the ratchet handle 78, often with the use of a handle extending "cheater bar" to add increased leverage. Once the final tension is achieved it is intended for the operator to move the handle 78 to the disengaged or stowed position, typically the rearward position, to prepare the winch for safe tension release when desired. In the embodiments shown, the marine winch is configured such that movement of the handle 78 to the stowed position will engage one leg 102, through handle engaging stop 104, and pivot the leg members 102 and the stop 110 against the force of spring 112 to a position allowing release of winch tension, such as shown in FIGS. 6-7, 10 and 13-14

As noted above, the knockout lever 86 is conventionally used to disengage the pawls 84 from the gears 82 to release tension on the winch 50, when desired. When controlled payout is desired a footbrake, or handbrake, or similar structure is engaged and the knockout lever 86 is utilized to disengage the pawls 84 from the gears 82 to allow for slow payout. Alternatively, the winch tension release is allowed to be somewhat rapid and the handbrake is not used.

It should be apparent that in the present invention when the handle 78 is not in the stowed or disengaged position, the safety knockout override 10 of the invention prevents release of the winch tension. Specifically, FIGS. 3-5 and 9 are illustrations of the safety knockout override according to the first embodiment of the present invention, wherein the safety knockout override 100 is positioned to prevent the release of winch tension because the stop 110 is positioned to prevent the disengaging movement of the knockout lever 86 and/or the pawls 84.

FIG. 11 is an illustration of the safety knockout override 100 according to the second embodiment of the present invention, wherein the safety knockout override 100 is positioned to prevent the release of winch tension also because the stop 110 is positioned to prevent the disengaging movement of the knockout lever 86 and/or the pawls 84.

Finally in the third embodiment of the present invention shown in FIG. 13 the safety knockout override 100 includes a gear 122 coupled to the drum and which is selectively engaged by the projecting stop 110 when the handle 78 is not in the stowed position. Thus in the third embodiment, while the knockout 86 can technically be operated with the handle 78 in the undesirable operative position, the gear 122 that is engaged by the stop 110 operates to prevent winch tension release that could cause undesirable rapid movement of the handle 78. In the third embodiment it is likely that the pawls 84 may need to be reengaged to allow for movement of the handle to the stowed position.

The three illustrated designs are intended to show the wide variety of the present invention each of which may be easily retrofitted into existing winches in the field.

Although the present invention has been described with particularity herein, the scope of the present invention is not limited to the specific embodiment disclosed. It will be apparent to those of ordinary skill in the art that various modifications may be made to the present invention without departing from the spirit and scope thereof. The scope of the present invention is defined in the appended claims and equivalents thereto.

What is claimed is:

1. A manual marine winch comprising:

a winch housing;

a rotating drum assembly supported on the winch housing; and a winch line selectively spooled and un-spooled on the drum, a manually actuated control for spooling and un-spooling the winch line on the drum, wherein the manually actuated control includes a handle for selectively tensioning the drum and moveable between a position engaged with the drum in at least one rotational direction for tensioning of the winch line on the drum and stowed position wherein the handle is not engaged with the drum;

a tension holding mechanism on the winch housing comprising at least one ratchet gear coupled to the drum, at least one pawl selectively engaged with said at least one ratchet gear to hold tension on the winch line on the drum, and a knockout configured to selectively disengage said at least one pawl from an associated ratchet gear to allow for release of tension on the winch;

wherein the improvement comprises a safety knockout override coupled to the winch housing moveable between an engaged and disengaged position, wherein in the engaged position the safety knockout override prevents disengagement of said at least one pawl from the associated ratchet gear for release of winch tension, and wherein the safety knockout override is in the engaged position when the handle is engaged with the drum.

2. The marine winch of claim 1 wherein the safety knockout override includes at least one leg member extending from a mounting member coupled to the winch housing.

3. The marine winch of claim 2 wherein the mounting member is a pivot member, and wherein one leg member includes a projecting stop at a distal end thereof spaced from the pivot member, and wherein the stop is selectively engaged with one of the knockout and each of said at least one pawl of the tension holding mechanism when the handle is not in the stowed position and configured to prevent disengagement of the said at least one pawl from the associated ratchet gear when the handle is not in the stowed position.

4. The marine winch of claim 3 wherein the mounting member is a pivot member which extends substantially parallel to an axis of the drum.

5. The marine winch of claim 1 wherein the safety knockout override includes a pair of leg members extending from a mounting member coupled to the winch housing.

6. The marine winch of claim 5 wherein the safety knockout override further includes a spring member coupled to one of the pair of leg members, wherein the spring member biases the safety knockout override to the engaged position preventing release of winch tension.

7. The marine winch of claim 6 wherein the winch is configured such that movement of the handle to the stowed position will move the leg members to a position allowing release of winch tension.

8. The marine winch of claim 7 wherein one leg member includes a projecting stop at a distal end thereof spaced from the mounting member.

9. The marine winch of claim 8 wherein the stop is selectively engaged with one of the knockout and each of said at least one pawl of the tension holding mechanism when the handle is not in the stowed position and configured to prevent disengagement of said at least one pawl from the associated ratchet gear when the handle is not in the stowed position.

10. The marine winch of claim 9 wherein the mounting member is a pivot member which extends substantially parallel to an axis of the drum.

11. The marine winch of claim 9 wherein the mounting member is a pivot member which extends substantially perpendicular to an axis of the drum.

12. The marine winch of claim 8 wherein the mounting member is a pivot member which extends substantially parallel to an axis of the drum.

13. The marine winch of claim 12 wherein the safety knockout override includes a gear coupled to the drum and selectively engaged by the projecting stop when the handle is not in the stowed position.

14. The marine winch of claim 5 wherein the winch is configured such that movement of the handle to the stowed position will move the leg members to a position allowing release of winch tension.

15. The marine winch of claim 14 wherein one leg member includes a projecting stop at a distal end thereof spaced from the mounting member.

16. The marine winch of claim 15 wherein the stop is selectively engaged with one of the knockout and each of said at least one pawl of the tension holding mechanism when the handle is not in the stowed position and configured to prevent disengagement of said at least one pawl from the associated ratchet gear when the handle is not in the stowed position.

17. The marine winch of claim 16 wherein the mounting member is a pivot member which extends substantially parallel to an axis of the drum.

18. The marine winch of claim 16 wherein the mounting member is a pivot member which extends substantially perpendicular to an axis of the drum.

19. The marine winch of claim 15 wherein the mounting member is a pivot member which extends substantially parallel to an axis of the drum.

20. The marine winch of claim 19 wherein the safety knockout override includes a gear coupled to the drum and selectively engaged by the projecting stop when the handle is not in the stowed position.

* * * * *